US010005533B2

(12) United States Patent
Weber et al.

(10) Patent No.: US 10,005,533 B2
(45) Date of Patent: Jun. 26, 2018

(54) MARINE ELECTRIC POWER ASSIST STEERING SYSTEM WITH CABLE

(71) Applicant: Steering Solutions IP Holding Corporation, Saginaw, MI (US)

(72) Inventors: John E. Weber, Pinconning, MI (US); Brian G. Maust, Unionville, MI (US); Brant R. Colbry, Summerville, SC (US)

(73) Assignee: STEERING SOLUTIONS IP HOLDING CORPORATION, Saginaw, MI (US)

( * ) Notice: Subject to any disclaimer, the term of this patent is extended or adjusted under 35 U.S.C. 154(b) by 0 days. days.

(21) Appl. No.: 15/293,698

(22) Filed: Oct. 14, 2016

(65) Prior Publication Data

US 2017/0106960 A1 Apr. 20, 2017

Related U.S. Application Data

(60) Provisional application No. 62/242,530, filed on Oct. 16, 2015.

(51) Int. Cl.

| | |
|---|---|
| ***B63H 25/04*** | (2006.01) |
| ***G05D 1/02*** | (2006.01) |
| ***B63H 25/02*** | (2006.01) |
| ***B63H 25/00*** | (2006.01) |
| ***B63H 20/12*** | (2006.01) |
| ***B63H 25/20*** | (2006.01) |
| *B63H 5/125* | (2006.01) |
| *B63H 20/08* | (2006.01) |
| *B63H 20/10* | (2006.01) |

(52) U.S. Cl.
CPC ..... *B63H 20/12* (2013.01); *B63H 25/20* (2013.01); *B63H 2020/103* (2013.01)

(58) Field of Classification Search
CPC .... B63H 20/08; B63H 2020/08; B63H 20/12; B63H 25/00; B63H 25/14; B63H 25/16; B63H 25/18; B63H 25/20; B63H 25/22; B63H 25/24; B63H 25/42; B63H 25/52; B63H 2025/00; B63H 25/2042
USPC ..... 440/61 S, 61 A, 61 B, 61 C; 114/144 R, 114/144 RE, 144 A, 144 B
See application file for complete search history.

(56) References Cited

U.S. PATENT DOCUMENTS

| | | | | |
|---|---|---|---|---|
| 5,074,193 | A * | 12/1991 | Hundertmark | B63H 20/12 440/60 |
| 5,241,894 | A * | 9/1993 | Hundertmark | B63H 20/12 440/60 |
| 9,669,914 | B1 * | 6/2017 | Hundertmark | B63H 20/12 |
| 2003/0186600 | A1 * | 10/2003 | Ozawa | B63H 25/30 440/61 S |

* cited by examiner

*Primary Examiner* — Daniel V Venne
(74) *Attorney, Agent, or Firm* — Cantor Colburn LLP

(57) ABSTRACT

A marine electric power steering system includes an input assembly, a steering actuator, and a cable assembly. The input assembly is operatively connected to a steering shaft. The input assembly has a steering sensor assembly and a motor assembly. The steering actuator is disposed within a pontoon and is in communication with the steering sensor assembly. The cable assembly extends through a wall of the pontoon. The cable assembly operatively connects the steering actuator and a steering device that is pivotally mounted to the pontoon.

14 Claims, 1 Drawing Sheet

MARINE ELECTRIC POWER ASSIST STEERING SYSTEM WITH CABLE

CROSS-REFERENCES TO RELATED APPLICATIONS

This patent application claims priority to U.S. Provisional Patent Application Ser. No. 62/242,530, filed Oct. 16, 2015 which is incorporated herein by reference in its entirety.

BACKGROUND OF THE INVENTION

Marine vehicles equipped with outboard motors conventionally use a steering system having a steering wheel remotely located from the outboard motor. The steering system generally incorporates hydraulic systems including a motor, a pump, hydraulic fluid tank, valves, and switches to assist (e.g. smooth out) the loads encountered when steering. The hydraulic steering systems may present challenges such as a high cost, possible hydraulic fluid leaks, high energy usage, and difficulty in installing. Other mechanical steering systems, such as, a cable steering systems also present challenges such as rough and uneven steering force application, vibrations from the outboard motor transmitted to the helm, and difficulty in routing the cables

SUMMARY OF THE INVENTION

According to an embodiment of the present disclosure, a marine electric power steering system is provided. The marine electric power steering system includes an input assembly, a steering actuator, and a cable assembly. The input assembly is disposed within a helm and at least partially disposed about a steering shaft. The input assembly has a steering sensor assembly and a motor assembly. The steering actuator is disposed within a transom well and in communication with the input assembly. The steering actuator has a linear actuator and a connecting portion that extends from the linear actuator. The cable assembly has a first end that is operatively connected to the connecting portion and a second end that is operatively connected to a steering device.

According to another embodiment of the present disclosure, a marine electric power steering system is provided. The marine electric power steering system includes an input assembly, a steering actuator, and a cable assembly. The input assembly is operatively connected to a steering shaft. The input assembly has a steering sensor assembly and a motor assembly. The steering actuator is disposed within a pontoon and is in communication with the steering sensor assembly. The cable assembly extends through a wall of the pontoon. The cable assembly operatively connects the steering actuator and a steering device that is pivotally mounted to the pontoon.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Referring now to the Figures, where the invention will be described with reference to specific embodiments, without limiting same, it is to be understood that the disclosed embodiments are merely illustrative examples of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
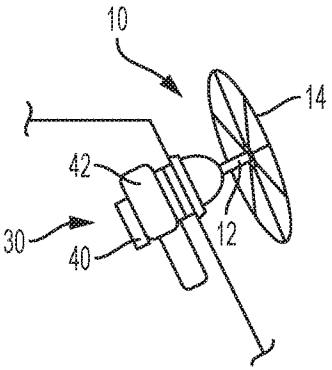
FIG. 1 a side view of a helm of a marine vessel.
Figure 3:
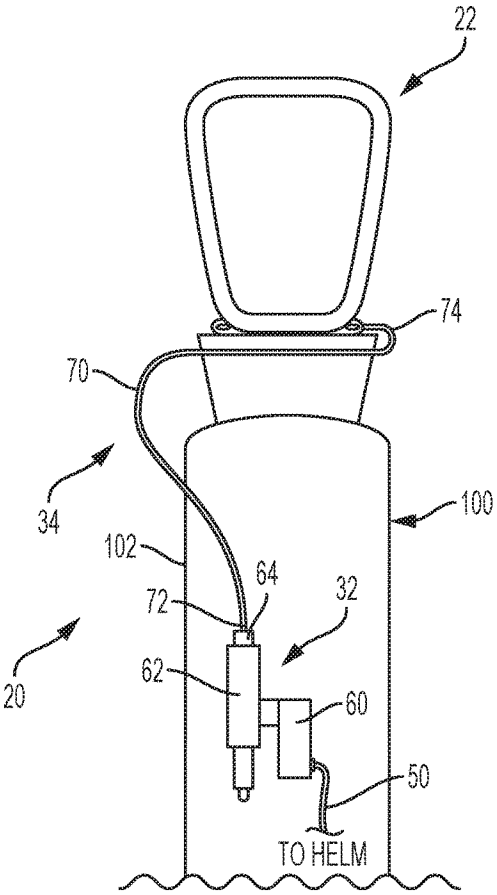
FIG. 3 is a top view of a marine electric power steering system disposed within a pontoon of the marine vessel.
Figure 2:
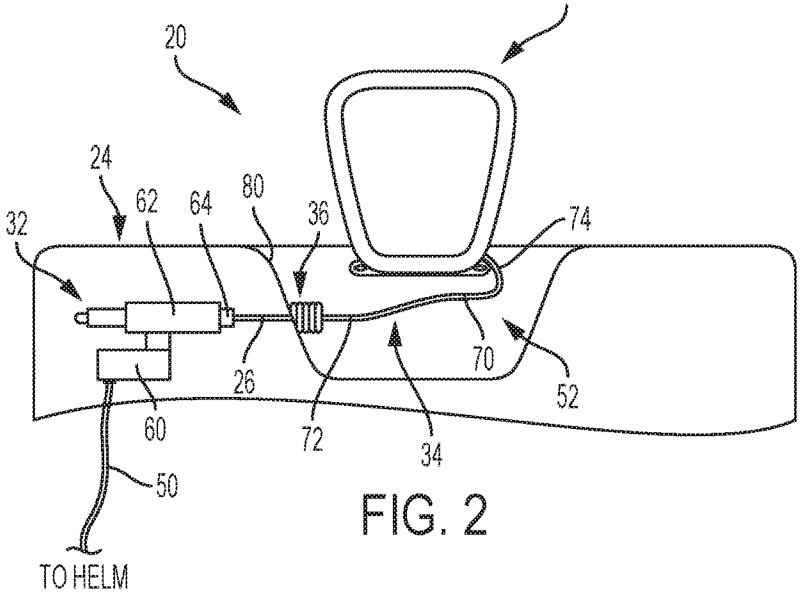
FIG. 2 is a top view of a marine electric power steering system disposed within a transom well of a marine vessel.

Referring to FIG. 1, a side view of a helm 10 of a marine vessel is shown. The helm 10 is provided with a marine vessel such as a fiberglass boat as shown in FIG. 2 or a pontoon boat as shown in FIG. 3. These are merely illustrative examples of marine vehicles or watercraft that the embodiments described herein may be used in conjunction with.

The helm 10 includes a steering shaft 12 that is operatively connected to a steering wheel 14. The steering shaft 12 extends along a steering axis. An operator of the marine vessel is able to provide a steering input into the steering wheel 14 such that the steering shaft 12 and the steering wheel 14 rotate about the steering axis.

Referring to FIG. 2, the helm 10 is in communication with a marine electric power steering system 20 that is configured to move or actuate a steering device 22 of the marine vessel to steer or maneuver the marine vessel in response to an input provided at the steering wheel 14. The steering device 22 is an outboard motor that is pivotally connected to a portion of a transom 24 and at least partially within a transom well 52 of the marine vessel includes a steering rod 26 that extends from a portion of the outboard motor.

The marine electric power steering system 20 includes an input assembly 30, a steering actuator 32, a cable assembly 34, and a sealing boot 36.

Referring to FIGS. 1 and 2, the input assembly 30 is disposed within the helm 10. The input assembly 30 is at least partially disposed about the steering shaft 12. The input assembly 30 is configured as a column electric power steering unit (CEPS). The input assembly 30 includes a steering sensor assembly 40 and a motor assembly 42.

The steering sensor assembly 40 is arranged to monitor and/or measure a torque applied to the steering shaft 12 and/or the steering wheel 14. The steering sensor assembly 40 may also be arranged to monitor and/or measure a rotational position or angular position of the steering shaft 12 and/or the steering wheel 14 relative to an end of travel stop. The steering sensor assembly 40 is configured to provide a signal indicative of a torque applied to the steering shaft 12 and/or the steering wheel 14 or an angular/rotational position of the steering shaft 12 and/or the steering wheel 14, in response to actuation of the steering shaft 12 and/or the steering wheel 14. The steering sensor assembly 40 is configured to provide the signal to the motor assembly 42 and the steering actuator 32.

The motor assembly 42 is disposed about or is operatively connected to the steering shaft 12. The motor assembly 42 is in communication with the steering sensor assembly 40.

The motor assembly 42 is arranged to provide a feedback torque to the steering shaft 12 in response to the signal. The feedback torque is based on at least one of a speed of the marine vessel, an angular position of the steering shaft 12 and/or the steering wheel 14, and a torque applied to the steering wheel 14 and/or the steering shaft 12. The feedback torque is applied to the steering shaft 12 to rotate or provide a resistive force to the steering shaft 12 and the steering wheel 14 in a direction that is disposed opposite a direction of rotation of the steering shaft 12 and the steering wheel 14 as rotated by the operator of the marine vessel to steer or maneuver the marine vessel. The feedback torque may be adjusted based on preferences of the operator of the marine vessel. The feedback torque may also be increased as at least one of the steering shaft 12 and the steering wheel 14 approaches the end of travel stop.

The steering sensor assembly 40 of the input assembly 30 is in communication with the steering actuator 32. The input assembly 30 is not directly mechanically coupled to the steering actuator 32 and is instead configured as a steer by wire system. The input assembly 30 may be electrically coupled to the steering actuator 32 via a control wire 50 or wireless communication. The steering actuator 32 is disposed within the transom 24 proximate a transom well 52 of the marine vessel. The steering actuator 32 is configured as a rack electric power steering unit (REPS). The steering actuator 32 actuates the cable assembly 34 to move or actuate the steering device 22 in response to the signal provided by the steering sensor assembly 40 of the input assembly 30.

The steering actuator 32 includes a power steering controller 60, a linear actuator 62, and a connecting portion 64. The power steering controller 60 is in communication with the input assembly 30. The power steering controller 60 receives the signal provided by the steering sensor assembly 40 and provides a control signal to the linear actuator 62. The power steering controller 60 is programmed to determine an amount of power steering assist torque, an angular position of the steering device 22, and/or a position/length of the linear actuator 62 based on the signal.

The power steering controller 60 includes at least one of a microprocessor or central processing unit in communication with various types of computer readable storage devices or media. Computer readable storage devices or media may include volatile and nonvolatile storage in read-only memory (ROM), random-access memory (RAM), and keep-alive memory (KAM), for example. KAM is a persistent or nonvolatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the power steering controller 60 in controlling the steering device 22.

The linear actuator 62 is configured as an electronic rack and pinion steering mechanism. The rack and pinion steering mechanism includes an electric motor drive, a motor pinion gear, and a toothed rack. The electric motor drive is connected to the toothed rack by the motor pinion gear, such that the motor pinion gear is in meshed engagement with the toothed rack. The operation of the electric motor drive results in rotation of the motor pinion gear to linearly translate the toothed rack. The toothed rack includes a connection point that is disposed proximate an end of the toothed rack. In at least one embodiment, the toothed rack is configured as a ballscrew mechanism, belt drive, or other gear interface capable of providing linear motion.

The connecting portion 64 extends from an end of the toothed rack of the linear actuator 62. The cable assembly 34 is operatively connected to the connecting portion 64 such that in response to the signal, the linear movement of the linear actuator 62 and the connecting portion 64 moves the cable assembly 34 to move or actuate the steering device 22 about a pivot point.

The cable assembly 34 is configured as a push pull cable assembly such that the linear movement of the linear actuator 62 pushes or pulls the cable assembly 34 to move or actuate the steering device 22 about a pivot point. The cable assembly 34 extends between the steering actuator 32 and the steering device 22. The cable assembly 34 includes a cable body 70 that extends between a first end 72 and a second end 74. The first end 72 is operatively connected to the connecting portion 64 of the steering actuator 32. The second end 74 is operatively connected to the steering device 22. In at least one embodiment, the second end 74 is operatively connected to the steering rod 26 of the steering device 22. The cable body 70 extends at least partially through a wall 80 of the transom well 52.

The sealing boot 36 is disposed on the wall 80 of the transom well 52. The sealing boot 36 is configured to seal an opening through which the cable body 70 of the cable assembly 34 at least partially extends through. The sealing boot 36 extends from the wall 80 of the transom well 52 towards the steering device 22.

Referring to FIG. 3, the helm 10 is in communication with a marine electric power steering system 20 is configured to move or actuate a steering device 22 that is mounted and is pivotally connected to a pontoon 100 of the marine vessel. The marine electric power steering system 20 is arranged to accommodate the pontoon configuration of the marine vessel.

Referring to FIGS. 1 and 3, the steering actuator 32 is disposed within the pontoon 100. The steering actuator 32 is mounted to an interior surface of a wall 102 of the pontoon 100. The linear actuator 62 of the steering actuator 32 extends towards the steering device 22 that is mounted to and is pivotally connected to the pontoon 100.

The cable assembly 34 operatively connects the steering actuator 32 and the steering device 22 that is mounted to and is pivotally connected to the pontoon 100. The first end 72 is operatively connected to the connecting portion 64 of the steering actuator 32. The second end 74 is operatively connected to the steering device 22. In at least one embodiment, the second end 74 is operatively connected to the steering rod 26 of the steering device 22. The cable body 70 extends at least partially through the wall 102 of the pontoon 100.

The sealing boot 36 may be disposed on the wall 102 of the pontoon 100. The sealing boot 36 is configured to seal an opening through which the cable body 70 of the cable assembly 34 at least partially extends through.

Throughout this specification, the term "attach," "attachment," "connected," "coupled," "coupling," "mount," or "mounting" shall be interpreted to mean that a structural component or element is in some manner connected to or contacts another element, either directly or indirectly through at least one intervening structural element, or is integrally formed with the other structural element.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A marine power steering system, comprising:

an input assembly disposed within a helm and at least partially disposed about a steering shaft, the input assembly having a steering sensor assembly and a motor assembly;

a steering actuator disposed within a transom and in communication with the input assembly, the steering actuator having a linear actuator and a connecting portion extending from the linear actuator; and a cable assembly having a first end operatively connected to the connecting portion and a second end operatively connected to a steering device.

2. The marine electric power steering system of claim 1, wherein the cable assembly at least partially extends through a wall of a transom.

3. The marine electric power steering system of claim 2, further comprising:

a sealing boot disposed on the wall of the transom and extends towards the steering device and the cable assembly extends through the sealing boot.

4. The marine electric power steering system of claim 2, wherein the steering sensor assembly is configured to provide a signal indicative of at least one of a torque applied to the steering shaft and an angular position of the steering shaft to the steering actuator.

5. The marine electric power steering system of claim 4, wherein in response to the signal, the motor assembly is configured to apply a feedback torque to the steering shaft.

6. The marine electric power steering system of claim 5, wherein the feedback torque is based on a speed of a marine vessel.

7. The marine electric power steering system of claim 5, wherein the feedback torque is based on a rotational position of the steering shaft.

8. The marine electric power steering system of claim 5, wherein in response to the signal, the linear actuator is configured to move the cable assembly to pivot the steering device about a pivot point.

9. A marine power steering system, comprising:

an input assembly operatively connected to a steering shaft, the input assembly having a steering sensor assembly and a motor assembly;

a steering actuator disposed within a pontoon and in communication with the steering sensor assembly; and a cable assembly extending through a wall of the pontoon, the cable assembly operatively connects the steering actuator and a steering device that is pivotally mounted to the pontoon.

10. The marine electric power steering system of claim 9, wherein the steering actuator includes a linear actuator and a connecting portion disposed at an end of the linear actuator.

11. The marine electric power steering system of claim 10, wherein the cable assembly includes a first end that is connected to the connecting portion, a second end that is connected to the steering device, and a cable body extending between the first end and the second end.

12. The marine electric power steering system of claim 11, wherein the steering sensor assembly is operatively connected to a steering shaft coupled to a steering wheel.

13. The marine electric power steering system of claim 12, wherein in response to actuation of the steering wheel, the steering sensor assembly provides a signal indicative of an angular position of the steering wheel to the steering actuator.

14. The marine electric power steering system of claim 13, wherein based on the signal, the linear actuator translates such that the cable assembly at least one of pushes and pulls the steering device.

* * * * *